United States Patent [19]

Ogar, Jr. et al.

[11] Patent Number: 4,765,916

[45] Date of Patent: Aug. 23, 1988

[54] POLYMER FILM COMPOSITION FOR RINSE RELEASE OF WASH ADDITIVES

[75] Inventors: George W. Ogar, Jr., Dublin; Clement K. Choy, Walnut Creek, both of Calif.

[73] Assignee: The Clorox Company, Oakland, Calif.

[21] Appl. No.: 30,192

[22] Filed: Mar. 24, 1987

[51] Int. Cl.[4] ..... C11D 17/06; C11D 17/04; D06M 13/46; D06M 13/54

[52] U.S. Cl. ..... 252/8.9; 252/8.8; 252/90; 252/95; 252/174.13; 252/DIG. 3; 252/DIG. 15; 206/524.2; 206/524.3; 206/524.7; 206/524.9; 428/913

[58] Field of Search ..... 252/DIG. 3, 8.6, 90, 252/174.13, 8.9; 206/524.2, 524.3, 524.7, 524.9; 428/507, 532, 913

[56] References Cited

U.S. PATENT DOCUMENTS

| | | | |
|---|---|---|---|
| 2,554,850 | 5/1951 | Binda | 88/65 |
| 3,113,674 | 12/1963 | Kiefer et al. | 206/84 |
| 3,198,740 | 8/1965 | Dunlop, Jr. et al. | 252/90 |
| 3,528,921 | 9/1970 | Gray | 252/99 |
| 3,534,851 | 10/1970 | Peterson et al. | 206/0.5 |
| 3,850,901 | 11/1974 | Tanaka et al. | 260/91.3 |
| 3,892,905 | 7/1975 | Albert | 428/220 |
| 4,082,678 | 4/1978 | Pracht et al. | 252/8.6 |
| 4,098,969 | 7/1978 | Zimmermann et al. | 526/9 |
| 4,108,600 | 8/1978 | Wong | 8/137 |
| 4,115,292 | 9/1978 | Richardson | 252/90 |
| 4,176,079 | 11/1979 | Guerry et al. | 252/90 |
| 4,188,304 | 2/1980 | Clarke et al. | 252/93 |
| 4,234,442 | 11/1980 | Cornelissens | 252/90 |
| 4,289,815 | 9/1981 | Lee | 428/35 |
| 4,323,492 | 4/1982 | Zimmermann et al. | 524/388 |
| 4,348,293 | 9/1982 | Clarke et al. | 252/90 |
| 4,416,791 | 11/1983 | Haq | 252/90 |
| 4,557,852 | 12/1986 | Schultz et al. | 252/95 |
| 4,626,372 | 12/1986 | Kaufmann et al. | 252/90 |

FOREIGN PATENT DOCUMENTS

| | | |
|---|---|---|
| 1100260 | 5/1981 | Canada . |
| 4137047 | 10/1979 | Japan . |
| 2090603 | 7/1982 | United Kingdom . |

*Primary Examiner*—Dennis Albrecht
*Assistant Examiner*—K. Markowski
*Attorney, Agent, or Firm*—Michael J. Mazza; Joel J. Hayashida; Stephen M. Westbrook

[57] ABSTRACT

A polymeric film for the rinse release of wash additives comprises an outer film layer of a hydroxybutylmethylcellulose (HBMC)/hydroxypropylmethylcellulose (HPMC) blend. An inner film layer is a PVA film having a metalloid oxide cross-linking agent present in an amount sufficient to cause the PVA film to gel in a pH of below about 9.0. Both film layers include a plasticizer and may include a surfactant. The film can be used as a seal for an insoluble container, or made into a water-soluble pouch. Optionally, either a third film layer of the HBMC/HPMC blend, or a nonwoven fabric layer may be included for greater durability. The films remain intact during normal wash cycles and over a range of typical water temperatures, then rapidly dissolve in the rinse.

18 Claims, 1 Drawing Sheet

POLYMER FILM COMPOSITION FOR RINSE RELEASE OF WASH ADDITIVES

BACKGROUND OF THE INVENTION

1. Field of the Invention

The present invention relates to water-soluble polymeric materials for use with wash additives, and more particularly to water-soluble polymeric films for rinse-release of wash additives.

2. Description of the Prior Art

Water-soluble polymeric films are known in the art and described in several references. Such polymeric films are used in packaging materials to simplify dispersing, pouring or dissolving the materials. As used herein "polymer" means a macro-molecule made up of a plurality of chemical subunits (monomers). The monomers may be identical or chemically similar, or may be of several different types. Unless a more specific term is used, "polymer" will be taken to include hetero- and homo- polymers, and random, alternating, block and graft copolymers. Water-soluble film packages can be directly added to the mixing vessel, advantageously avoiding contact with toxic or messy materials, and allowing accurate formulation in the mixing vessel. Soluble pre-measured polymeric film pouches aid convenience of consumer use in a variety of applications, particularly those involving wash additives. The use of polyvinyl alcohol (PVA) films to contain laundry products is hampered by the range of wash temperatures typically employed. PVA films of the art generally exhibit their greatest solubility in hot water (above 90° F.) with varying degrees of solubility in warm (75° F.) and cold (40° F.) water. As used hereinafter, wash additive refers to those materials which are intended for use, or are most efficacious in a rinse portion of a wash cycle and are intended to improve the aesthetics, feel, appearance, sanitation or cleanliness of fabrics or wares washed in machine washing apparatus. Such wash additives are preferably added to a rinse portion of a wash cycle after an alkaline detergent wash has occurred, and include but are not limited to fabric softeners, brighteners, anti-redeposition agents and bleaches. It is desirable to effectuate the release of the additives during the rinse cycle, rather than during the wash portion of the wash cycle. It is further desirable to add these products initially, at the start of the wash cycle, thereby avoiding the need to monitor the wash cycle, interrupt it to add the additive, and restart the machine. Polymeric films used to contain such additives would have to be insoluble during the wash phase, remain insoluble throughout cold, warm, or hot water washes, and become soluble during the rinse phase.

U.S. Pat. No. 4,626,372, issued to Kaufmann et al discloses a PVA film soluble in wash liquors containing borate. Richardson et al. U.S. Pat. No. 4,115,292 shows enzymes embedded in water-soluble PVA strips, which are in turn encased in a water-soluble polymeric film pouch which may be PVA, both of which may include cellulose ethers therewith. Albert. U.S. Pat. No. 3,892,905 discloses a cold-water soluble film which may be useful in packaging detergents. British patent application No. 2,090,603 (Sonenstein) describes a packaging film having both hot and cold water solubility and formed from a blend of polyvinyl alcohol and polyacrylic acid. Haq, U.S. Pat. No. 4,416,791 describes a detergent delivery pouch of a water-soluble PVA layer and a water-insoluble polytetrafluoroethylene layer which encloses liquid additives. U.S. Pat. No. 4,234,442 issued to Cornelissens discloses a dual package pouch delivering an acidic detergent component and an alkaline detergent component. The pouch is composed of a mixture of different water-soluble polymers. Wong, U.S. Pat. No. 4,108,600 shows a detergent composition in a water-insoluble container having at least one porous wall and containing an additive coated with a water-soluble polymeric material. The polymeric material includes an electrolyte, which may be borate, to achieve a pH dependent release. Dunlap, U.S. Pat. No. 3,198,170, shows a cold-water soluble detergent packet of PVA containing a granular detergent having a hydrated salt to maintain moisture in the film. Schultz et al, U.S. Pat. No. 4,557,852 describes a copolymeric water-soluble film for packaging wash additives. The film comprises a water-insoluble "soft" monomer plus a water-soluble anionic monomer. Pracht et al, U.S. Pat. No. 4,082,678 describes an article for rinse-release of actives consisting of an outer pouch or container which has at least one water-soluble wall, of, for example PVA, and an inner receptacle having at least one soluble wall of, for example, PVA or methylcellulose. The inner soluble wall is insolubilized during the wash by an electrolyte or pH control agent which may be sodium borate. Guerry et al, U.S. Pat. No. 4,176,079 describes a wash additive enclosed in a water-soluble polymer of e.g., PVA or methylcellulose. Zimmermann et al, U.S. Pat. No. 4,098,969 shows PVA with boric acid as a means of reducing the solubility of the PVA. Shinetsu, JP No. 54-137047 shows a film of a polyvinyl alcohol phosphate and a nonionic water-soluble cellulose such as methylcellulose.

Accordingly, there remains a need for a water-soluble delivery system for a wash additive, which will remain insoluble during hot, warm, or cold water wash conditions but will rapidly and fully solubilize during rinse conditions to release the wash additives.

It is therefore an object of the present invention to provide a pH dependent, temperature independent, water-soluble additive release means.

It is another object of the present invention to provide a means for delivery of wash additives, which means may be added at the start of a wash cycle and which will deliver the wash additives during a rinse portion of the cycle.

SUMMARY OF THE PRESENT INVENTION

Briefly, a first embodiment of the present invention comprises a free-standing water-soluble film for use in effecting a rinse release of a wash additive. The film is preferably a laminate, with at least one methylcellulose film layer of a hydroxybutylmethylcellulose (HBMC)/hydroxypropylmethylcellulose (HPMC) blend, and at least one film layer of a polyvinyl alcohol (PVA) polymer incorporating a cross-linking agent. The cross-linking agent reversibly cross-links the PVA, reducing its solubility in basic conditions, e.g., during the wash cycle. The methylcellulose film blend possesses inverse solubility (greater solubility in cold water than in hot) and the combination provides for a film having a solubility which is pH dependent and temperature independent. While the laminate film is preferred for strength reasons, it is within the scope of this invention to support the film layers, either by making the film intrinsically supporting, or by providing an extrinsic support, in such a way as to provide an air or fluid space between the layers. In a second embodiment, the film is made into a pouch and filled with wash additives which advantageously are released in the rinse, for example, fabric softeners and brighteners. In either the first or the second embodiments, the film laminate can be used in conjunction with a fabric layer for greater durability with heavy loads. Optionally with these embodiments, an additional methylcellulose layer, disposed adjacent to the PVA layer, may be included for greater strength and durability. In a third embodiment, the methylcellulose and polyvinyl alcohol resins are not formed into films and laminated; instead they are coated on to individual additive particles to result in a dry granular additive which may be formulated with a detergent product and which maintains its rinse release capabilities. In a process aspect, the present invention encompasses treating fabrics or wares by adding a film article containing a wash additive to a washing machine. The article will remain intact during the wash and solubilize in the rinse to release the additive.

It is therefore an advantage of the present invention that a delivery composition for the rinse-release of wash additives is provided.

It is another advantage of the present invention that the rinse release is retained over a range of typical wash and rinse water temperatures.

It is another advantage of the present invention that it may be fabricated as a pouch to contain the rinse-release additives.

It is a further advantage of the present invention that it may be fabricated as a coating for a granular wash additive.

These and other objects and advantages of the present invention will no doubt become apparent to one of ordinary skill in the art after having read the following Detailed Description of the Preferred Embodiments.

IN THE DRAWINGS

DETAILED DESCRIPTION OF THE PREFERRED EMBODIMENTS

Figure 1:
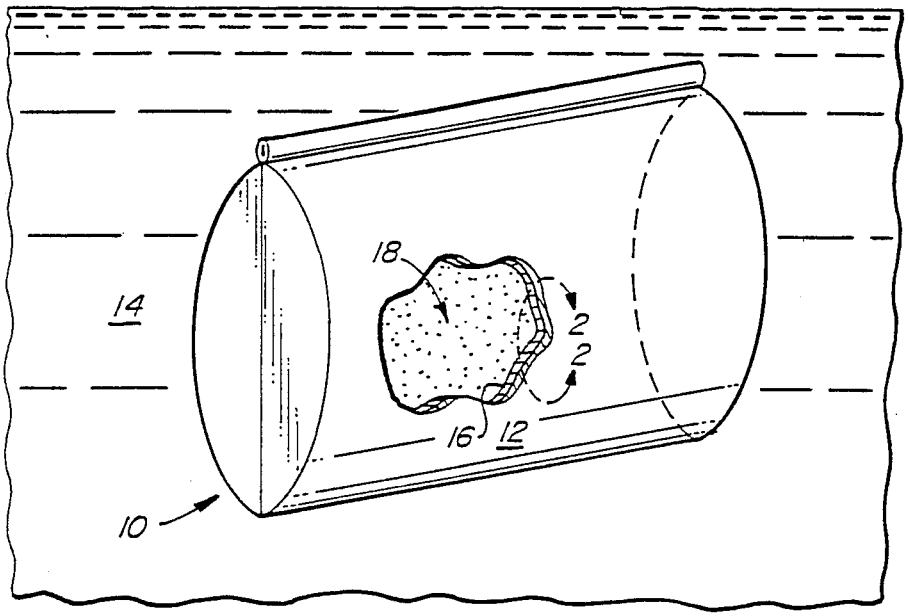
FIG. 1 is a perspective view of a laminated film pouch of the present invention.

A first embodiment of the present invention comprises a film laminate having a composite HBMC/HPMC layer (MC layer) and a polyvinyl alcohol (PVA) film layer. As used in this embodiment, the term film describes a continuous, homogenous, dimensionally stable polymer having a small thickness in relation to area, i.e., less than about 0.01 inches. The PVA layer includes a cross-linking agent to render the PVA layer insoluble in alkaline wash conditions while maintaining the PVA's solubility in less alkaline rinse conditions. The MC layer possesses an inverse solubility such that the layer is relatively insoluble in warm or hot water but fully soluble in cold water. The film may be used as a water-soluble seal for an insoluble container for a wash additive, or it may be made into a completely water-soluble pouch for containing and delivering an additive. In either case, the film and additive should be arranged such that the MC layer is first exposed to the wash waters, then the PVA layer, and finally, the additive. In washes below about 90° F., the MC layer will be predominantly dissolved, however the PVA layer will remain intact owing to the relatively low temperature, alkaline pH, and presence of the cross-linking agent. Between about 90° F. to 130° F. the MC layer remains intact through at least an initial portion of the wash cycle to aid in protecting the thermally-sensitive PVA from dissolving. In washes above about 130° F., the MC layer may not dissolve until the rinse. Regardless of whether the MC layer is fully or partially dissolved, or remains undissolved in the wash portion of the cycle, upon encountering the lower temperature rinse the MC quickly dissolves. The PVA also rapidly dissolves in the rinse due to the decreased alkalinity therein, and an additive contained within the film is fully exposed to the rinse medium.

Methylcellulose

The methylcellulose film (MC) layer is a blend of hydroxypropylmethylcellulose (HPMC) and hydroxybutylmethylcellulose (HBMC) resins, with the percentage of each depending on the solubility and gel characteristics of the respective methylcellulose polymers. A preferred weight average molecular weight range of the HPMC is from about 10,000 to about 86,000 g/mole, and a range for the HBMC is about 26,000 to 120,000 g/mole. A more preferred weight range is 10,000 to 30,000 g/mole HPMC and 90,000 to 115,000 g/mole HBMC. The upper limit of the molecular weight ranges for each type of methylcellulose resin may be higher depending on availability. Critical to the success of the invention is the blend of HBMC and HPMC. HBMC has a negligible rate of solubility at temperatures above about 120° F., which is its thermal gel point. This gel is very stable, once formed, and will not break-up during the short period of the rinse (typically about 3 minutes). The HPMC, by contrast, has a thermal gelation temperature of about 158° F. and will not gel during the hottest wash temperatures. The solubility of the HPMC alone is relatively high in warm or hot water, thus HPMC cannot be used alone, but by blending the HPMC with the HBMC, the rate of solubility of the MC layer is controlled to be relatively slow in hot water, yet rapid in cold water. Table 1 shows wash and rinse breakup times for films of various combinations of MC resins. Data for Table 1 were obtained using film strips of about 1" by 1" and about 0.001 inches in thickness, and were tested in beakers holding 1 liter of the test solution. Laundry washes using TIDE detergent (a registered trademark of the Procter and Gamble Co., Cincinnati, Ohio) were simulated by adding sufficient $Na_2CO_3NaHCO_3$ to deionized water to raise the pH to about 10. Deionized water, at a temperature of about 70° F., pH about 8, was used for the rinse.

TABLE 1

| Film | Wash Temp. | Wash Breakup (10 min. wash) | Cold Rinse Breakup (If survived 10 min. wash) |
|---|---|---|---|
| HBMC[1] | 24° C. (75° F.) | 90 secs | — |
| " | 38° C. (100° F.) | None | 400 secs |
| " | 52° C. (125° F.) | None | 525 secs |
| HPMC[2] | 24° C. (75° F.) | 120 secs | — |
| " | 38° C. (100° F.) | 300 secs | — |
| " | 52° C. (125° F.) | 340 secs | — |
| HPMC/ | 24° C. (75° F.) | 330 secs | — |
| HBMC[3] | 38° C. (100° F.) | None | instant |

TABLE 1-continued

| Film | Wash Temp. | Wash Breakup (10 min. wash) | Cold Rinse Breakup (If survived 10 min. wash) |
|---|---|---|---|
| | 52° C. (125° F.) | None | 5 secs |

[1]MW of 115,000 g/mole
[2]MW of 18,000 g/mole
[3]65% 18,000 g/mole HPMC/35% 115,000 g/mole HBMC A preferred ratio of HPMC to HBMC is from about 9:1 to about 1:1. More preferred is about 7:1 to 3:2. A preferred mixture is 54% of 18,000 g/mole HPMC and 29% of 115,000 g/mole HBMC. The remaining 17% of the film composition includes a plasticizer and optionally, a surfactant. A commercial source of the HPMC and HBMC resins are the METHOCEL resins, which are trademarked products of the Dow Chemical Company.

A MC film layer is made by first adding about 1 to 30% of a plasticizer and about 0 to 1% of a surfactant to an appropriate amount of deionized water. The resulting solution is heated to about 90° C. and the methylcellulose resin mixture is added thereto. After resin addition is complete, the solution is cooled and degassed. Films are cast from the solution as is known in the art, using, for example, a Gardner film applicator. The cast films may be air dried or heat dried, as is known in the art. Thickness of the MC film may vary from about 0.5 mils to about 2.0 mils and preferably from about 1.0 to 1.5 mils. Increasing the film's thickness will improve its durability but at some loss of dissolution rate. In embodiments where two MC film layers are used, the layers may be identical or different in composition, in thicknesses, or both. Typically the layers will be of identical composition but will differ in thickness. Where a second MC layer is employed, the layer serves primarily as structural support for the PVA layer, and consequently may be somewhat thinner than the first MC layer. The first MC layer will generally be about 1.0 to 1.5 mils thick, and the second layer may be about 0.5 to 1.0 mils thick.

PVA

Polyvinyl alcohol resin for the PVA layer can range in weight average molecular weight from about 10,000 to about 125,000 g/mole, and in percent hydrolysis from about 75% to 98%. Preferred is PVA with a weight average molecular weight of about 49,000 to 96,000 g/mole and an 88% hydrolysis. The lower molecular weight ranges are most preferred in order to obtain a film with the least sensitivity to borate-containing laundry compositions, however, the higher molecular weight PVA provides additional film strength in the two-layer embodiment. Commercial sources of PVA resins include the Hoechst Company, E.I. dupont de Nemours and Company, Nippon Synthetic Chemical Co., Ltd., Air Products and Chemicals, Inc., and Wacker-Chemie GmbH. A plasticizer is added in an amount of from about 1 to 30% by weight of the resin. The PVA film layer may also include a surfactant. The same surfactants preferred for use with the MC film are also preferred for the PVA film, and in about the same amounts. Crucial to the success of the invention is the inclusion of a cross-linking agent with the PVA resin. The cross-linking agent is chosen to be one which reversibly cross-links the PVA in a basic solution, such as in the presence of a typical laundry detergent.

Most preferred for the PVA layer is about 82% of a 96,000 g/mole PVA resin having a degree of hydrolysis of about 88%. Commercial examples of the most preferred PVA resin for forming the films are available from the Nippon Synthetic Chemical Co. under the trademark GOHSENOL GL-05, or from Air Products and Chemicals, Inc. under the trademark VINOL 205. The remaining PVA film layer ingredients include the plasticizer, the cross-linking agent, and optionally, a trace of a surfactant. The film layer is made by first adding the plasticizer and surfactant to an appropriate amount of room temperature deionized water. The PVA resin is added slowly, followed by the addition of an aqueous solution of cross-linking agent. The solution is heated to about 90° C. to allow the PVA resin to completely dissolve (about 30 min), and is then cooled and degassed. Film formation is accomplished by any means known in the art, for example, by solution casting. The cast films are dried as is known in the art. The PVA film thickness may vary from about 0.1 mils to about 10.0 mils, and it is preferred that the layer be about 1.0 to about 2.5 mils thick for optimum rinse release.

Surfactant

A surfactant may be included with both the PVA film and the MC film primarily as an antifoamer and secondarily as a wetting agent. Virtually any surfactant known in the art to be suitable for this purpose can be incorporated in the films of the present invention, and nonionic surfactants are preferred. Non-limiting examples include the ethoxylated aliphatic alcohols, ethoxylated alkylphenols, polyols and $C_{6-10}$ aliphatic alcohols. Preferred are the ethoxylated aliphatic alcohols such as Union Carbide Corporation's trademarked TERGITOL series and specifically TERGITOL 15-S-3. Other examples are polyethylene glycol ether and octyl alcohol. Generally the choice of surfactant will be dictated by the composition of the PVA resin and MC resins. The surfactant aids in degassing the polymer solutions, allowing the production of films free from air bubbles. While the polymer solution can be degassed with or without the surfactant, the operation is very time consuming without the surfactant, owing to the high viscosity of the polymer resin solution. The surfactant secondarily aids in initially dispersing the polymer resin particles in solution; preferably a single surfactant can perform both functions, but optionally a dispersing surfactant can be added along with the antifoamer surfactant. Surfactant levels are sufficient to result in the desired antifoaming and/or wetting and may range from 0% to about 1.0%, preferred is about 0.05% to 0.5%.

Plasticizer

Both the PVA and MC film layers require a plasticizer to impart malleability and flexibility to the resins to allow film formation. A variety of plasticizers known in the art for use with the PVA and MC resins, respectively, can be used with the PVA and MC resins herein. Such plasticizers include, but are not limited to, aliphatic polyols especially bihydric to hexahydric two to six carbon alkanols, and mixtures thereof. Particularly preferred are ethylene glycol, glycerol, trimethylolpropane, neopentylglycol, and polyethylene glycol (PEG). Most preferred for the PVA film is glycerol, and PEG for the MC film. The plasticizer used for the PVA film may be the same or different than that used for the methylcellulose film. The plasticizers are added in an amount sufficient to plasticize the PVA and MC resins, respectively. A preferred level of plasticizer in both the PVA and the MC layers is about 1% to 50% of the film composition, more preferred about 5% to 30%. Higher levels of plasticizer in the PVA layer correlate with an increase in water solubility of the film. Variations in the amount of plasticizer in the PVA layer thus allow such solubility rates to be adjusted for optimum performance.

Cross Linking Agent

Metalloid oxides such as boric, telluric and arsenic acid, precursors thereof and mixtures thereof are incorporated into the PVA film to control the solubility thereof in an alkaline solution, which is generally indicated by a pH of above about 9.0–9.5. The metalloid oxide reversibly cross-links the PVA under such alkaline conditions, sharply reducing its rate of solubility. When placed in less alkaline conditions, i.e., having a pH below about 9.0–9.5, the cross-links are reversed and the film regains its normal solubility. The cross-linking agent is the key element in triggering rinse release of the wash additive, since such release is pH dependent. Most preferred as the cross-linking agent is boric acid ($H_3BO_3$). It is also contemplated that the metalloid oxides could be added in salt form, e.g., sodium borate, tellurate, arsenate or other similar salts. These compounds are less preferred than addition of the cross-linking agent in oxide (acid) form, as the salt forms tend to begin cross-linking when added to the PVA resin solution, making it more difficult to obtain the desired film. Without wishing to be bound by a particular theory, it is believed that the boric acid complexes the PVA by the following mechanism:

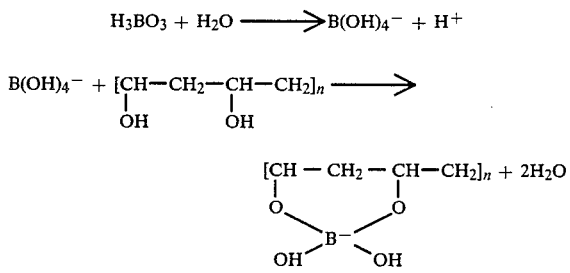

-continued

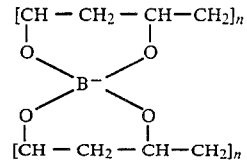

Levels of cross-linking agent are dictated primarily by the physical parameters of the PVA film layer, e.g., molecular weight, percent hydrolysis and thickness, and secondarily by the additive and wash conditions. Generally, the concentration of cross-linking agent should be sufficient to sharply reduce the solubility of the polymer in alkaline wash conditions. This criterion is satisfied with a level of cross-linking agent between about 0.05% to 9% by weight of the PVA film. Most preferred is about 0.5% to 1.5% by weight. The upper range will, of course, result in more cross-linking and a slower rate of reversibility. Functionally, it is believed that the cross-linking agent reduces the solubility of the PVA by increasing its effective molecular weight. It is desired that the solubility be reduced such that the polymer will gel under the alkaline wash conditions. Assuming a viscosity of about 100,000 CPS indicates a gel, the effective molecular weight of the PVA polymer must be above about $2.0\times10^8$ g/mole for gellation to occur.

Table 2 shows the amount of borate necessary to achieve this effective molecular weight range of gellation, for various molecular weights of PVA. It can be seen that the lower MW films require a higher cross-link density, i.e., more borate, to attain gellation. While it is preferred to incorporate the cross-linking agent directly into the PVA film, it is also within the scope of the invention to maintain the film in contact with the cross-linking agent during the wash. This may be done by adding the cross-linking agent to the wash solution, or by encasing it within the PVA, as with the additive. If the cross-linking agent is added in this manner, somewhat higher levels are needed to sufficiently cross-link the PVA, and should range from about 1–15% by weight. Combinations of the above, e.g., a cross-linking agent in both the wash liquid and in the film are also satisfactory.

TABLE 2

THE EFFECTIVE MOLECULAR WEIGHTS AND CROSS-LINK DENSITIES FOR BORATE-PVA SOLUTIONS
% HYDROLYSIS = 88%

| MW PVA[a] | Moles of $Na_2B_4O_7$ | Moles of $B(OH)_4^-$ | Viscosity (cPs) | Viscosity Effective Molecular Weight | Cross-Link Density[b] |
|---|---|---|---|---|---|
| 10,000 | $1.50\times10^{-3}$ | $3.00\times10^{-3}$ | 44,000 | $9.78\times10^{7}$ | $4.29\times10^{-2}$ |
| 49,000 | $5.26\times10^{-4}$ | $1.05\times10^{-3}$ | 208,400 | $4.63\times10^{8}$ | $1.50\times10^{-2}$ |
| 96,000 | $3.00\times10^{-4}$ | $6.00\times10^{-4}$ | 70,300 | $1.56\times10^{8}$ | $8.57\times10^{-3}$ |
| 96,000 | $3.75\times10^{-4}$ | $7.50\times10^{-4}$ | 182,400 | $4.05\times10^{8}$ | $1.07\times10^{-2}$ |
| 125,000 | $2.63\times10^{-4}$ | $5.26\times10^{-4}$ | 102,800 | $2.28\times10^{8}$ | $7.51\times10^{-3}$ |

[a]The moles of monomeric unit (No) present in the PVA solutions was 0.14.
[b]The cross-link density (P) is the fraction of monomeric units which are cross-linked. V/2 is the number of moles of $B(OH)_4$ present and since there are two cross-linked monomeric units for each cross-linkage:

$$P = \frac{V}{No}$$

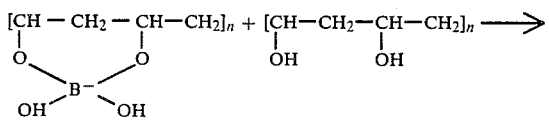

While most detergent compositions are sufficiently alkaline to allow cross-linking of the PVA therein, certain commercial detergents result in a solution pH of about eight. To compensate for this, it is within the scope of the present invention to include sufficient of a pH adjusting agent to raise the solution pH to about nine. Preferred for such a purpose is sodium carbonate or sodium bicarbonate, and it may be separately added to the wash, or combined with the additive.

Procedure

The film laminate (MC plus PVA) is made by any means known in the art, and preferably by double casting, i.e., a first film layer of MC or PVA is cast and dried, and the complementary film (PVA or MC) is cast atop the first, in an abutting relationship. The two-layer film may be made into a pouch either by joining two sheets of film about their edges or by folding over a single sheet and sealing the edges thereof. In either case, virtually any sealing means known in the art may be used, and heat/impulse sealing is preferred. The resulting film is free standing and sufficiently strong to be used as a seal for an insoluble container, or to be made into a fully water-soluble pouch. In pouch form, the film of the present invention is sufficiently strong to resist mechanically-induced breakage in a washing machine, yet provides the desired temperature independent, pH dependent release of additive. With the two-layer film in pouch form, it is important that the pouch be formed in such a way that the methylcellulose layer is on the outside, and the PVA layer is disposed internally, adjacent to the additive. This also allows sealing of the PVA layer to itself, which provides a secure seal. In the event that the pouch is subjected first to a warm or hot water wash, the outer MC layer acts to protect the PVA layer from the higher temperature water, which would dissolve the PVA despite the presence of the cross-linking agent. Greater structural stability of the films of the present invention can be obtained by making a three-layer laminate with an additional MC layer. This layer is identical to the first MC layer and bonded to the PVA layer to form a sandwich with the PVA intermediate to the two MC layers. Sealing of the three layer film is hampered somewhat by the need to seal the inner MC layer to itself. To improve the sealability of the MC layer, a thin (about 0.5 mil) PVA layer may be cast onto the third MC layer as a sealing aid. This layer does not alter the solubility characteristics of the composite film, but serves only to provide a good seal. A pouch made of such a three-layer laminate film will retain the desired rinse-release solubility characteristics, and will be more durable enabling its use with heavier wash loads and/or more vigorous agitation.

In the second embodiment, the present invention comprises the films (which can be either two or three layer laminates) in combination with a wash additive, and preferably in pouch form. The laminate film is preferred for use in combination with the additive since it provides the best combination of strength and rinse-release. However, the MC and PVA film layers may also be supported in such a way as to provide an air or fluid space between them. This can be accomplished using, for example, an insoluble rigid container filled with an additive and having a sealable aperture. Forming each film layer into a pouch and placing an additive inside the PVA pouch, which is in turn placed inside the MC pouch, also results in nonadhering film layers. The films are as described above, and the preferred rinse release additive, i.e., a fabric softener, is described below.

Additive

Virtually any additive can be used with the films of the present invention to result in an additive combination for wash addition and rinse release. Preferred additives are fabric softeners such as the cationic quaternary ammonium compounds and imidazolinium compounds. Particularly preferred of the quaternary ammonium compounds are those having at least one $C_{14-26}$ saturated or unsaturated R group, and at least two methyl groups. Preferred imidazolinium compounds include 1-methyl-1-alkylamidoethyl-2-alkylimidazolinium methosulfate wherein the alkyls are $C_{14-20}$. Most preferred is a product sold by the Sherex Chemical Company under the trademark AROSURF TA-100.

Other wash additives which will provide optimum benefits when released during the rinse cycle can be used to fill the pouch, and include brighteners, anti-redeposition agents, certain bleaches such as peroxygen bleaches, and combinations of any of these. The only limitation on the additive is that it should not react with the polymers of the film to alter their solubilities.

Optionally in this embodiment, the present invention comprises the film pouch, further supported by a fabric, e.g., nonwoven material which gives additional support and enhances pouch longevity in heavy wash loads and/or under heavy agitation. The nonwoven material can be disposed adjacent to either the MC or PVA layer, and preferred is to place it adjacent to the PVA. The fabric can be either bonded to the polymeric laminate or it can be used as a matrix and the PVA layer can be cast directly thereon. Alternatively a coextrusion process may be employed to combine the polymeric films and fabric material. The fabric material may also be made into a separate, outer pouch to encase the polymeric pouch. Preferably the polymeric film is of the two layer variety since the nonwoven material provides much more support and strength than does the third MC layer. As previously described, virtually any additive which is advantageously released with the rinse can be used with the polymeric/fabric pouch of the present invention.

Figure 2:
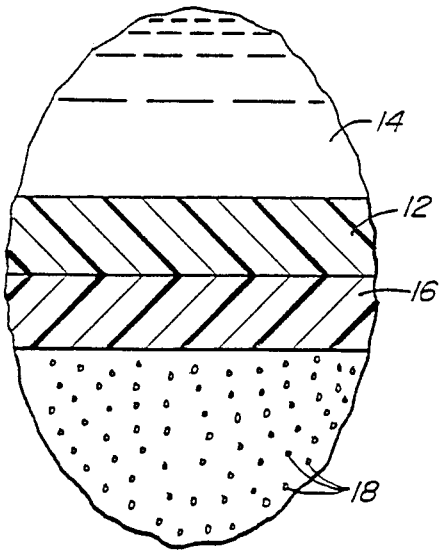
FIG. 2 is an enlarged, cross-sectional view, taken along line 2—2 of FIG. 1.
Figure 3:
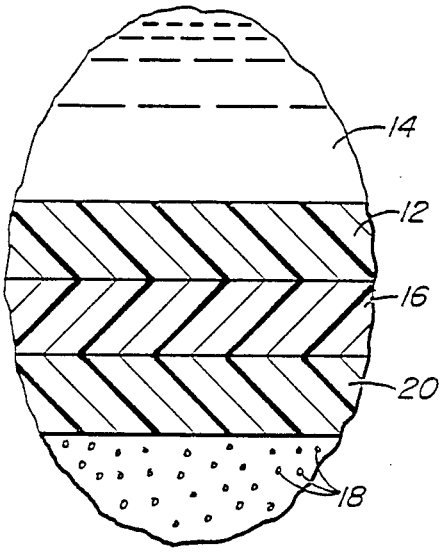
FIG. 3 is an enlarged cross-sectional view of an alternative embodiment of the film of the present invention.

FIG. 1 is an idealized, perspective view, partially in section of a pouch of the present invention, represented by the general reference numeral 10. The pouch 10 includes a first outer MC film layer 12 disposed in contact with a wash environment 14. Adjacent to the layer 12 is a second layer 16, comprising the PVA layer, and is disposed adjacent to an additive 18. FIG. 2 is an expanded cross-sectional view of the film layers, taken along line 2—2 of FIG. 1, and further illustrating the relationships of the MC film layer 12, the wash environment 14, the PVA layer 16 and the additive 18. FIG. 3 illustrates an alternative embodiment of the film of the present invention wherein the film includes a third MC layer 20, intermediate to the PVA layer 16 and the additive 18. A third embodiment of the invention contemplates using the MC and PVA layers as coatings for dry additive particles or to encapsulate liquid droplets, rather than as films. In this embodiment, polymeric solutions would be alternately coated or encapsulated directly onto a plurality of additive particles or droplets in any manner known in the art for such coating or encapsulation. For best results the additive particle size should be between about 10 to 400 microns, preferably between about 50 to 150 microns. The polymeric layers can range in thickness from about 0.5 to 10 mils each depending on the particle size, polymer composition and intended end use of the additive. The polymeric layers may be made up as described for the first and second embodiments and diluted with deionized water to dilute solutions of about 0.5 to 2%. The order of the polymeric layers is as previously described i.e, a PVA layer is first coated onto a particle, then a MC layer is coated atop the first. If an additional MC layer is desired, it is coated first, then the PVA layer, followed by the outer MC layer.

The following non-limiting examples will further illustrate the present invention. As all films are aqueous compositions, the ingredient percentages are percentages of actives.

EXAMPLE 1

A methylcellulose film was made using about 54% 18,000 g/mole HPMC, about 29% 115,000 g/mole HBMC, about 17% PEG having a weight average molecular weight of 200 (PEG-200) and a trace of a surfactant/wetting agent. A PVA film was made using about 82.8% PVA (88% hydrolysis, weight average molecular weight of 96,000 g/mole), 16.6% glycerol, 0.66% $H_3BO_3$ and a trace of surfactant. Two methylcellulose layers were made: a first or outer layer about 1.5 mils in thickness and a third or inner layer about 0.9 mils thick. The PVA was made into a 1.35 mil film and formed the second or middle layer. The layers were laminated by triple casting with a Gardner film applicator, i.e., the first layer was cast and air dried for 24 hours, and the remaining layers were individually cast and dried atop the first. The resulting film was impulse sealed using a Packaging Industries Sentinel Sealer into a 2" by 2" pouch containing about 3 grams of a fabric softener. It was found that pouches so made lasted up to fourteen minutes in washes of any temperature between 75 and 125° F. and subsequently released actives in the rinse.

EXAMPLE 2

A methylcellulose layer for a two-layer film was made by combining about 66.6% of the 18,000 g/mole HPMC, about 16.6% of the 115,000 g/mole HBMC, about 16.6% of PEG-200 as plasticizer and about 0.05% of an ethoxylated aliphatic alcohol surfactant. The PVA layer was made by combining about 82.8% of an 88% hydrolyzed, 10,000 g/mole weight average molecular weight PVA resin with about 16.6% of a glycerol as plasticizer, 0.66% $H_3BO_3$ and a trace (about 0.05%) of an ethoxylated aliphatic alcohol surfactant. The PVA resin mixture was cast into a 2.0 mil film on a glass plate using a Gardner film applicator. The film was air dried, the MC solution was cast atop the PVA film layer to a thickness of about 1.0 mils, and also air dried. The resulting film was sealed into a pouch, with the PVA layer on the outside, as described for Example 1.

EXAMPLE 3

A three-layer, MC/PVA/nonwoven fabric film was made in accordance with following procedure. About 81% of 88% hydrolyzed 10,000 g/mole weight average molecular weight PVA, 16.6% of PEG-200 plasticizer, 2.4% $H_3BO$ (in 100 ml water) and a trace (about 0.05%) of an ethoxylated aliphatic alcohol surfactant were combined in an aqueous solution. A sheet of nonwoven material sold by The Crown Zellerbach Company under the trademark CELESTRA was cut into a rectangle of about 3"×8" and dipped into the PVA resin mixture. The sheet was placed on a glass plate to air dry, then was dipped into a MC resin solution made by combining, in aqueous solution, about 17.8% glycerine, 28.6% HBMC (115,000 g/mole weight average molecular weight) and 53.5% HPMC (18,000 g/mole weight average molecular weight). The sheet again placed on a glass plate to air dry. The resulting sheet was formed into a pouch and filled with a wash additive as described above.

EXAMPLE 4

The PVA solution of Examples 1, 2 or 3 may be made up and diluted to a 1% solution with deionized water. The solution is used to spray-coat particles of a fabric softener such as AROSURF TA-100. After drying, the particles are further spray coated with a 0.5% solution of methylcellulose in deionized water. The methylcellulose solution is made by combining 18,000 g/mole HPMC with 115,000 g/mole HBMC in a ratio of about 4:1, with a plasticizer.

Experimental

Table 3 shows wash breakup times (TIDE detergent wash) for various wash temperatures of a MC/PVA pouch and a nonwoven/MC/PVA pouch. The MC/PVA pouch was made as described in Example 2, and the nonwoven/MC/PVA pouch was made as described in Example 3. Breakup times for the nonwoven/MC/PVA pouch were obtained in the presence of ballast (6.0 pounds of cotton towels). Both types were observed during a fifteen minute wash.

TABLE 3

| | Wash Breakup time (sec) | |
|---|---|---|
| Wash Temp. | MC/PVA | Nonwoven/MC/PVA |
| 75° F. | 600 | None |
| 100° F. | 420 | 885 |
| 125° F. | 420 | None |

Table 4 shows wash breakup times for three wash temperatures and four ballast conditions for a MC/PVA/MC pouch (made as described in Example 1) in a TIDE detergent wash. Cotton towels were used as ballast.

TABLE 4

| | Wash Breakup time (sec) | | | |
|---|---|---|---|---|
| Wash Temp. | Control (No ballast) | 3.5 lb. | 7.0 lbs. | 10 lbs. |
| 75° F. | 1150 | 1200 | 820 | 500 |
| 100° F. | 1030 | 950 | 380 | 380 |
| 125° | 1200 | 950 | 490 | 150 |

Films of the present invention were prepared in accordance with Example 1 and made into pouches or used as a water-soluble seal for an insoluble container as indicated below. Table 5 shows wash breakup times, and rinse breakup times following an eight minute TIDE detergent wash, for three wash temperatures. The film used was an MC/PVA/MC laminate and was used with a container. The container was polyvinyl chloride, generally cylindrical in shape and having an internal capacity of about 10 $cm^3$. The container was provided with a screw-on cap having a circular aperture of about 8 $cm^2$ therein. The container was filled with about 3 g of a fabric softener. The film to be tested was placed within the cap, spanning the aperture and the cap was screwed onto the container, securing the film therein. The container was then added to a washing machine as indicated.

TABLE 5

| Wash Temp. | Time (sec) Wash Breakup | Rinse Breakup (following an 8 min wash) |
|---|---|---|
| 75° F. | 980 | 30 |
| 100° F. | 900 | 100 |
| 125° F. | 1,500 | 390 |

Table 6 results were obtained under the same conditions as Table 5 above, but with a fifteen minute wash using TIDE detergent plus a dry all fabric bleach manufactured and marketed by The Clorox Company under the registered trademark CLOROX 2.

TABLE 6

| Wash Temp. | Time (sec) Wash Breakup (after 15 min. wash) | Rinse Breakup (after 15 min. wash) |
|---|---|---|
| 75° F. | None | 30 |
| 100° F. | None | 120 |
| 125° F. | None | 380 |

Performance Data

Table 7 shows softening performance and static cling reduction for the MC/PVA/MC film of Example 1, made into a pouch and containing approximately 3 grams of the AROSURF TA-100 fabric softener. The other additives were used per the manufacturer's directions. Softening performance on terry cloth towels was evaluated by four judges using a nine point hedonic scale (+4 to −4). Each treatment was evaluated by a paired comparison with all other treatments and the preferred item was given a numerical score, with +4 corresponding to a strong preference of the item over the preceding item, −4 corresponding to a strong preference for the preceding item, and 0 being no difference. In each case a 10 minute TIDE detergent wash was employed. An average of the scores is shown.

Static reduction of a synthetic high static bundle of clothes was measured using a SIMCO electrostatic locator. A 3.75 pound bundle of various articles made of polyester, nylon, acrylic and tricot was washed in a 12 minute TIDE detergent wash, using 70° F. and 100° F. water with 100 ppm hardness, and followed by a two minute 70° F. rinse cycle. The fabric bundle was then placed in an automatic dryer for a 45 minute cycle, and on completion of the cycle, each garment was individually measured for voltage. A control was run on the same bundle without benefit of any treatment. Percent static reduction was calculated by subtracting the total voltage of the treated bundle from the total voltage of the untreated bundle, dividing this by the total untreated voltage, and multiplying by one hundred.

TABLE 7

| Treatment | Softening | Avg. Static Reduction |
|---|---|---|
| Control (TIDE detergent only) | 0 | 0 |
| Warm Wash plus pouch | 2.4 | 90% |
| Cold Wash plus pouch | 2.9 | 96% |
| Liquid Fabric Softener[1] | 3.6 | 97% |
| Dryer-added Fabric Softener[2] | 1.0 | 98% |

[1]DOWNY, a trademarked product of the Procter & Gamble Co.; added at a level equivalent to about 9.8 g of quaternary ammonium fabric softener.
[2]BOUNCE, a trademarked product of the Procter & Gamble Co.

While described in terms of the presently preferred embodiments, it is to be understood that such disclosure is not to be interpreted as limiting. Various modifications and alterations will no doubt occur to one skilled in the art after having read the above disclosure. Accordingly, it is intended that the appended claims be interpreted as covering all alterations and modifications as fall within the true spirit and scope of the invention.

What is claimed is:

1. A water-soluble, free-standing polymeric film comprising (a) a first film layer having a thickness of between about 0.5 to 2 mils, and comprising a mixture of hydroxybutylmethylcellulose (HBMC) with a weight average molecular weight of at least about 26,000 g/mole, hydroxypropylmethylcellulose (HPMC) with a weight average molecular weight of at least about 10,000 g/mole, and a first plasticizer, wherein a ratio of HPMC to HBMC is between about 9:1 to 1:1; and (b) a second film layer having a thickness of between about 0.1 to 10 mils, and comprising a mixture of a polyvinyl alcohol having a weight average molecular weight of at least about 10,000 g/mole, a degree of hydrolysis of between about 75% and 95%, a second plasticizer, and a quantity of a cross-linking agent sufficient to reduce the solubility of the film in an alkaline pH, the second film layer and the first film layer being disposed together in an abutting relationship.

2. The film of claim 1 wherein said first plasticizer is chosen from the group consisting of glycerols, glycerine, water and mixtures thereof; and said second plasticizer is chosen from the group consisting of polyethylene glycol, glycerol, water, and mixtures thereof.

3. The film of claim 1 wherein the HPMC and HBMC are present in a ratio of between about 7:1 to 3:2.

4. The film of claim 1 wherein the cross-linking agent is selected from the group consisting of boric acid, telluric acid, arsenic acid, salts thereof, precursors thereof and mixtures thereof.

5. The film of claim 4 wherein the cross-linking agent is present in an amount sufficient to result in an effective molecular weight of the PVA film layer of greater than about $2.0\times10^8$ g/mole.

6. The film of claim 1 and further including a third film layer, substantially identical to the first film layer and disposed adjacent to the second film layer such that the second film layer is intermediate to the first and third film layers.

7. A water-soluble polymeric film pouch comprising (a) a first film layer, having a thickness of between about 0.5 and 2 mils, and comprising a mixture of hydroxybutylmethylcellulose (HBMC), having a weight average molecular weight of at least about 26,000 g/mole, hydroxybutylmethylcellulose (HBMC), having a weight average molecular weight of at least about 10,000 g/mole, and a plasticizer, present in a plasticizing-effective amount, wherein a ratio hydroxypropylmethylcellulose (HPMC) to hydroxybutylmethylcellulose (HBMC) is between about 9:1 to 1:1; and (b) a second film layer having a thickness of between about 0.1 and 10 mils, and comprising a mixture of a polyvinyl alcohol PVA having a weight average molecular weight of between about 10,000 and 125,000 g/mole, a degree of hydrolysis of between about 75% and 95%, a plasticizer, present in a plasticizing-effective amount, and a quantity of a cross-linking agent sufficient to reduce the solubility of the film in an alkaline pH, the second film layer and first film layer being in pouch form with the second film layer disposed inside the first film layer and whereby an additive may be inserted into a cavity defined by said pouch, and sealed therein.

8. The pouch of claim 7 and further including
a wash additive sealed therein.

9. The pouch of claim 7 and further including
a layer of a nonwoven fabric adjacent to the second film layer whereby a combination soluble/insoluble pouch is formed.

10. A method of making a water-soluble polymeric pouch comprising (a) making a first film layer by combining a hydroxybutylmethylcellulose (HBMC) resin, having a molecular weight of at least about 26,000 g/mole, a hydroxypropylmethylcellulose (HPMC) resin having a molecular weight of at least about 10,000 g/mole, wherein a ratio of HPMC to HBMC is between about 9 to 1 and 1 to 1, adding thereto a plasticizer in an amount sufficient to plasticize said resin blend, and forming the resulting mixture into a film approximately 0.5 to 2 mils thick;

(b) making a second film layer by combining about 60% to 90% of a polyvinyl alcohol resin having a molecular weight of at least about 10,000 g/mole and a degree of hydrolysis of between about 75% to 95%, with a plasticizer in an amount sufficient to plasticize the PVA resin, and a quantity of a cross-linking agent sufficient to reduce the solubility of the film in an alkaline pH, and forming the resulting mixture into a film of about 0.1 to 10 mils thick; and (c) forming a sealable pouch of the first and second film layers wherein the first film layer is disposed toward an exterior of the pouch and the second film layer is disposed toward an interior of the pouch, and whereby an additive may be sealed therein.

11. A method for introducing a wash additive to an aqueous laundry solution during a rinse portion of a wash cycle, comprising (a) enclosing an additive in a container havinq at least one water-soluble polymeric film portion comprising a first, outer film layer having a thickness of between about 0.5 and 2 mils, and comprising a blend of an hydroxybutylmethylcellulose (HBMC) resin, having a weight average molecular weight of at least about 26,000 g/mole, and HPMC resin having a weight average molecular weight of at least about 10,000 g/mole, the HPMC resin being present in an amount of between about one to nine times the amount of hydroxybutylmethylcellulose (HBMC), and a plasticizer in an amount sufficient to plasticize the blend into a film, a second, inner film layer, having a thickness of between about 0.1 and 10 mils, and comprising a polyvinyl alcohol resin having a weight average molecular weight of at least about 10,000 and a degree of hydrolysis of between about 75% and 95%, a second plasticizer in an amount sufficient to plasticize said resin into a film, wherein the additive is disposed adjacent to and within the second film layer, which is adjacent to and disposed within the first film layer;

(b) adding the container to a first aqueous laundry solution, having a first pH;

(c) maintaining at least said water-soluble film portion of the container in said first solution in the presence of a cross-linking agent, present in an amount sufficient to reduce the solubility of the PVA in said first solution; and (d) replacing said first aqueous solution with a second aqueous solution having a second pH, said second pH being less than said first pH whereby said water-soluble film portion solubilizes, freeing the additive contained therein.

12. The method of claim 11 wherein
the container is a fully water-soluble pouch and the polymeric film portion is a laminate of the first and second film layers.

13. The method of claim 12 wherein
the polymeric film laminate includes a third film layer, adjacent to the second layer, and substantially identical to the first film layer, the second layer being intermediate to the first and third layers.

14. The method of claim 12 wherein
the polymeric film laminate includes a third layer of a fabric material, adjacent to the second layer, and intermediate to the first and third layers.

15. The method of claim 11 wherein
the cross-linking agent is present in the second film layer.

16. A wash additive composition for the rinse release of a wash additive comprising (a) a wash additive particle, having an average diameter of between about 10 to 400 microns;

(b) a first polymeric layer, about 0.5 to 10 mils in thickness, comprising a mixture of a PVA resin having a weight average molecular weight of at least about 10,000 g/mole and a degree of hydrolysis of about 75% to 98%, with a plasticizer, and about 0.05 to 9% of a cross-linking agent, the first polymeric layer being coated onto the additive particle; and (c) a seoond polymeric layer about 0.5 to 10 mils in thickness, coated onto the first layer and comprising a mixture of a hydroxybutylmethylcellulose (HBMC) resin, having a weight average molecular weight of at least about 90,000 g/mole, a hydroxypropylmethylcellulose (HPMC) resin, having a weight average molecular weight of between about 10,000 and 30,000 g/mole, the hydroxypropylmethylcellulose (HPMC) and hydroxybutylmethylcellulose (HBMC) being present in a ratio of between about 9:1 to 1:1, and a plasticizer.

17. A free standing water-soluble film seal for a container for a wash additive, the film seal comprising (a) a first film layer having a thickness of between about 0.5 to 2 mils, and comprising a mixture of hydroxybutylmethylcellulose (HBMC) with a weight average molecular weight of at least about 90,000 g/mole, hydroxypropylmethylcellulose (HPMC) with a weight average molecular weight of at least about 10,000 to 30,000 g/mole, and a plasticizer, wherein a ratio of hydroxypropylmethylcellulose (HPMC) to hydroxybutylmethylcellulose (HBMC) is between about 9:1 to 1:1; and (b) a second film layer having a thickness of between about 0.1 to 10 mils, and comprising a mixture of a polyvinyl alcohol PVA having a weight average molecular weight of at least about 10,000 g/mole, a degree of hydrolysis of between about 75% and 95%, a plasticizer, and a quantity of a cross-linking agent sufficient to reduce the solubility of the film in an alkaline pH, the second film layer and the first film layer being positioned in proximity to each other, the second layer being proximal to an additive, and the first layer being distal to said additive.

18. The film seal of claim 16 wherein the cross-linking agent is present to result in an effective molecular weight of the PVA layer of greater than about $2.0\times10^8$ g/mole.

* * * * *